US005131649A

United States Patent [19]

Martin et al.

[11] Patent Number: 5,131,649

[45] Date of Patent: Jul. 21, 1992

[54] MULTIPLE OUTPUT SHEET INVERTER

[75] Inventors: Michael J. Martin, Rochester; Vinod K. Agarwal, Webster; Gerald M. Garavuso, Farmington, all of N.Y.

[73] Assignee: Xerox Corporation, Stamford, Conn.

[21] Appl. No.: 635,834

[22] Filed: Jan. 3, 1991

[51] Int. Cl.[5] ..... B65H 39/10

[52] U.S. Cl. ..... 271/302; 271/65; 271/186; 271/301; 271/304; 271/902

[58] Field of Search ..... 271/186, 65, 184, 301-304, 271/902, 272

[56] References Cited

U.S. PATENT DOCUMENTS

| | | | |
|---|---|---|---|
| 4,699,367 | 10/1987 | Russel | 271/186 X |
| 4,735,409 | 4/1988 | Brown | 271/186 |
| 4,858,909 | 8/1989 | Stemmle | 271/184 |
| 4,871,163 | 10/1989 | Lande et al. | 271/902 |
| 4,986,529 | 1/1991 | Agarwal et al. | 271/186 X |

FOREIGN PATENT DOCUMENTS

| | | | |
|---|---|---|---|
| 128154 | 7/1984 | Japan | 271/65 |
| 185769 | 8/1988 | Japan | 271/184 |
| 28465 | 1/1990 | Japan | 271/186 |

*Primary Examiner*—Robert P. Olszewski
*Assistant Examiner*—Boris Milef
*Attorney, Agent, or Firm*—Finnegan, Henderson, Farabow, Garrett & Dunner

[57] ABSTRACT

The invention includes a sheet feeding apparatus having a sheet pocket with a first end and a second end, rollers spaced a predetermined distance from the first end and including a plurality of sheet-feeder nips, one of the nips being an inlet nip for directing a sheet into the first end of the sheet pocket, and at least one other of the nips being an exit nip for directing a sheet out of the first end of the sheet pocket, and bypass rollers for selectively permitting a sheet to exit the sheet pocket via the second end thereof.

15 Claims, 3 Drawing Sheets

MULTIPLE OUTPUT SHEET INVERTER

BACKGROUND OF THE INVENTION

1. Field of the Invention

The present invention relates to improvements in copy machine architecture including a multiple output inverter that serves to interchange the trail edge of a sheet with the lead edge while interchanging the bottom side of the sheet with the top side. The inverter also acts as a gating station to direct sheet to a proper paper path.

2. Description of the Related Art

Inverters are used in copiers to enable automatic duplex and color highlight copying. The main function of an inverter is to interchange the trail edge of the sheet with the lead edge, while interchanging the bottom side of the sheet with the top side. This general concept is depicted in FIG. 8.

Many prior art copy machines also include gating devices. Such gating devices include a movable guide at a crossroad for directing a sheet into one of a number of paper paths. Gates do not invert copy sheets, rather, they serve to direct sheets to a desired path.

Many copy machines employ at least one inverter as well as multiple gating stations. However, this structure is cumbersome and requires extraneous paper paths. The present inventors have developed an apparatus that serves as both an inverter and a gating station. This inverter/gating station eliminates excess paper paths and simplifies copier architecture.

An object of the present invention is to improve copier architecture to make copiers smaller and to eliminate unnecessary paper paths.

Another object of the present invention is to provide highly reliable sheet inverter.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

SUMMARY OF THE INVENTION

To achieve the objects and in accordance with the purposes of the invention, as embodied and broadly described herein, the sheet feeding apparatus of the present invention includes a sheet pocket having a first end and a second end, roller means spaced a predetermined distance from the first end and including a plurality of sheet-feeder nips, one of said nips for directing a sheet into said first end of said sheet pocket, and at least one other of said nips for directing a sheet out of said first end of said sheet pocket, and bypass means for selectively permitting a sheet to exit said sheet pocket via said second end thereof.

It is to be understood that both the foregoing general description and the following detailed description are exemplary and explanatory only and are not restrictive of the invention, as claimed.

The accompanying drawings, which are incorporated in and constitute a part of this specification, illustrate several preferred embodiments of the invention and together with the description, serve to explain the principles of the invention.

DESCRIPTION OF THE PREFERRED EMBODIMENTS

Reference will now be made in detail to the present preferred embodiments of the invention, examples of which are illustrated in the accompanying drawings. Wherever possible, the same reference numbers will be used throughout the drawings to refer to the same or like parts.

In accordance with the present invention, there is provided a sheet feeding apparatus having a sheet pocket with a first end and a second end. As embodied herein, and as depicted in FIG. 1, inverter/gating station 10 includes baffles 12 and 14 which cooperate to define sheet pocket 16.

Figure 1:
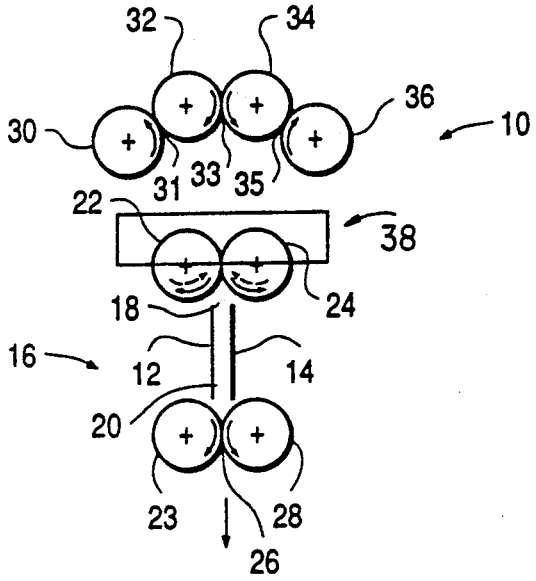
FIG. 1 is a schematic diagram of a bidirectional inverter/gating station in accordance with the present invention.

As disclosed in the embodiment of the invention depicted in FIG. 1, a pair of reversing rollers 22 and 24 are disposed adjacent the first end 18 of sheet pocket 16, and a pair of bypass rollers 26 and 28 are disposed adjacent the second end 20 of sheet pocket 16. Rollers 22, 24, 26, and 28 cooperate to control the movement of copy sheets into and out of sheet pocket 16.

Also in accordance with the invention, there is provided roller means spaced a predetermined distance from the first end of the sheet pocket and including a plurality of sheet feeder nips, one of the nips for directing a sheet into the first end of the sheet pocket, and at least one other of the nips for directing a sheet out of the first end of the sheet pocket. As embodied herein, roller means includes rollers 30, 32, 34 and 36. cooperating to define inlet nip 33 and two exit nips, 31 and 35. Roller 32 rotates clockwise and roller 34 rotates counterclockwise so that a sheet disposed in nip 33 therebetween is forwarded into sheet pocket 16. Roller 30 rotates counterclockwise and roller 32 rotates clockwise so that a sheet grabbed by first exit nip 31 is forwarded out of the first end 18 of sheet pocket 16 in a first direction. Likewise, roller 36 rotates clockwise to form a second exit nip 35 between rollers 3 and 36. A sheet grabbed by nip 35 is therefore forwarded out of the first end 18 of sheet pocket 16 in a second direction.

Initially, a copy sheet enters sheet pocket 16 through inlet nip 33 between rollers 32 and 34. Once in sheet pocket 16, the copy sheet may be directed through either one of the exit nips 31 and 35 by direction change mechanism 38. As shown in FIG. 1, direction change mechanism 38 includes reversing rollers 22 and 24 that change direction depending upon desired sheet travel. However, there are a number of alternative direction change mechanisms in accordance with the present invention, and as depicted in FIGS. 2–4.

Figure 2:
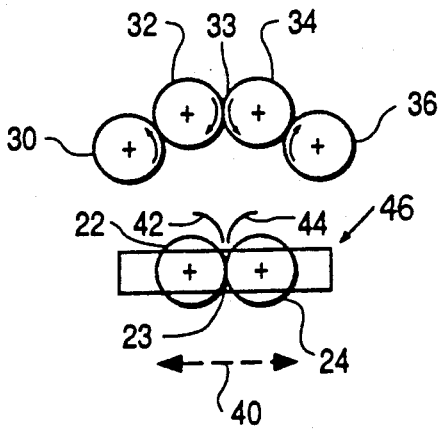
FIG. 2 is a schematic diagram depicting the motion of laterally moving shuttle shown in FIG. 1.

As shown in FIG. 2, reversing rollers 22 and 24 are mounted on a shuttle 46 that moves laterally in the direction of line 40. Initially, shuttle 46 is disposed so that the nip 23 between reversing rollers 22 and 24 is positioned directly beneath inlet nip 33 between rollers 32 and 34. Reversing roller 22 initially rotates clockwise while reversing roller 24 initially rotates counterclockwise to forward a sheet into sheet pocket 16. When a sheet in sheet pocket 16 is to be forwarded out of one of the first or second exit nips, shuttle 46 is moved in a lateral direction towards the desired nip and the rotation of reversing rollers 22 and 24 is reversed.

Baffles 42 and 44 may be provided between rollers 30, 32, 34 and 36, and reversing rollers 22 and 24 to aid in directing sheets between inlet 33, sheet pocket 16 and exit nips 31 and 35. However, depending upon specific design requirements, baffles 42 and 44 may be eliminated as shown in FIG. 1.

Figure 3:
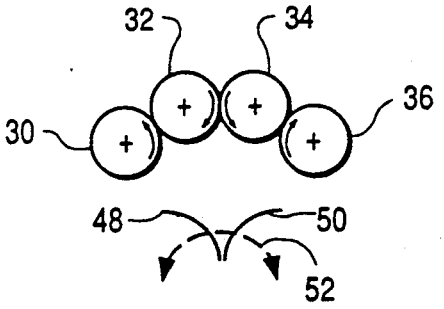
FIG. 3 is a schematic diagram of a pivoting baffle direction change mechanism in accordance with the present invention.
Figure 4:
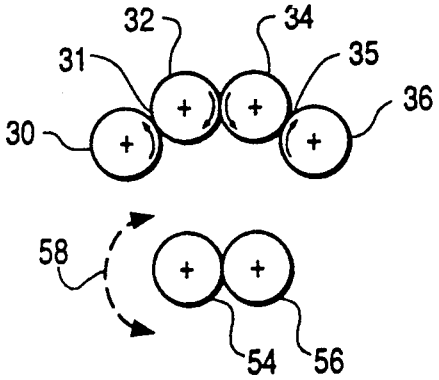
FIG. 4 is a schematic diagram of a pivoting roller direction change mechanism in accordance with the present invention.

As shown in FIG. 3, direction change mechanism 38 may include pivoting baffles 48 and 50. According to this embodiment, baffles 48 and 50 are displaced laterally as they pivot along an arc 52. Pivotal movement of baffles 48 and 50 serves to direct a sheet exiting sheet pocket 16 toward a desired exit nip.

As shown in FIG. 4, direction change mechanism 38 may include pivoting rollers 54 and 56. Similar to reversing roller 22 and 24, pivoting rolls 54 and 56 change direction depending upon whether a sheet is entering through the inlet nip 33 or exiting through one of the two exit nips 31 or 35. However, pivoting rolls 54 and 56 are displaced laterally when pivoting rolls 54 and 56 are pivoted in the direction of arc 58. This pivotal movement of pivoting rolls 54 and 56 directs a sheet leaving sheet pocket 16 toward a desired exit nip.

Also in accordance with the present invention, there is provided bypass means for selectively permitting a sheet to exit the sheet pocket via the second end thereof. As embodied herein, and as depicted in FIG. 1, bypass means includes bypass rollers 26 and 28 disposed adjacent the second end 20 of sheet pocket 16. A controller (not shown) may direct bypass rollers 26 and 28 to forward a sheet out of the second end 20 of sheet pocket 16 to provide a bypass exit from sheet pocket 16 alternate to first an second exit nips 31 and 35.

Figure 6:
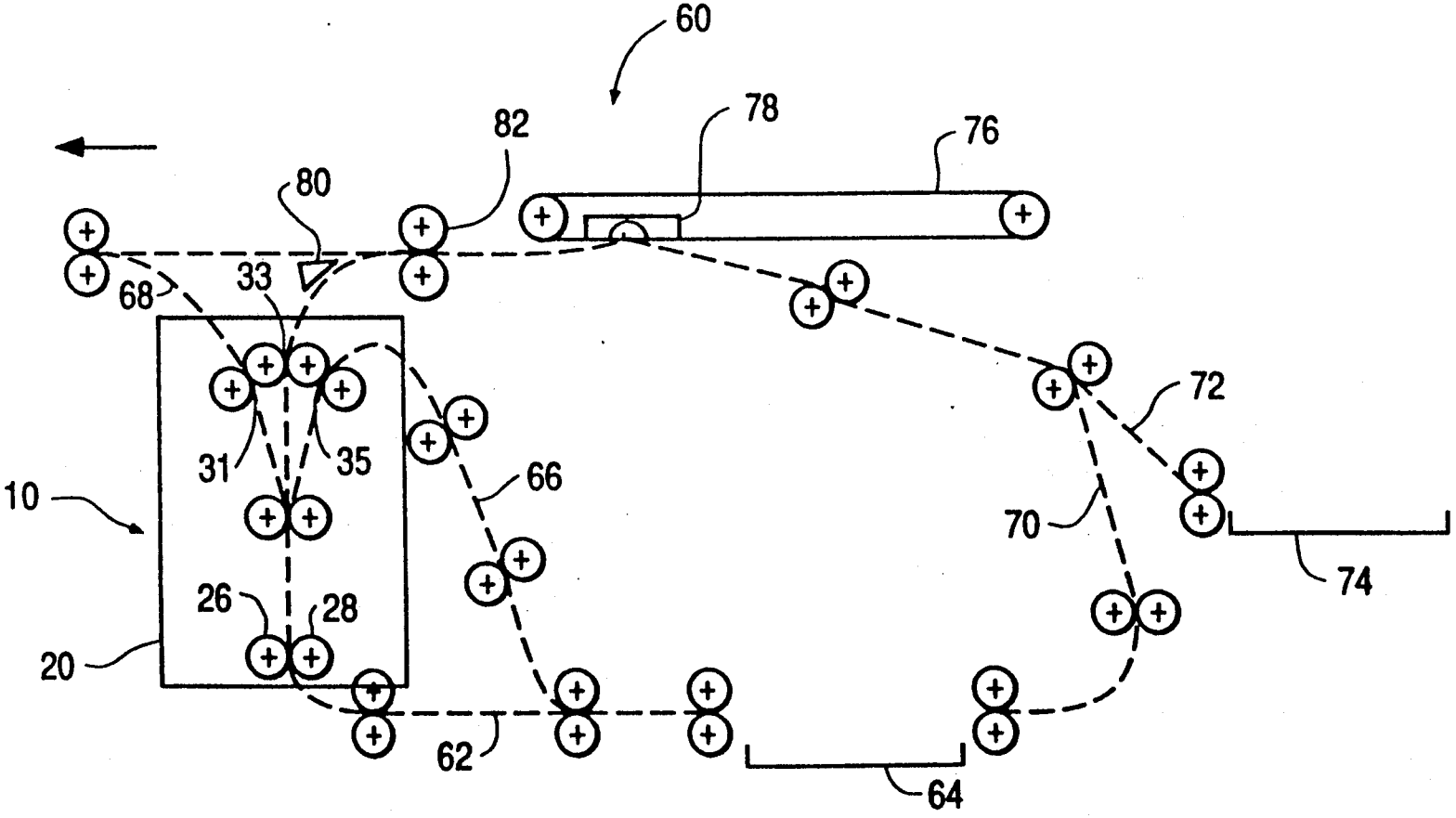
FIG. 6 is a schematic diagram of copy machine architecture in accordance with the present invention, employing the bidirectional inverter/gating station of FIG. 1.

The inverter/gating station 10 described above enables unique copier architecture such as the architecture depicted in FIG. 6. In copier 60 shown in FIG. 6, paper path 62 connects second end 20 of inverter/gating station 10 with duplex tray 64, and a second sheet path 66 extends from exit nip 35 to duplex tray 64. A third sheet path 68 extends from exit nip 31 to a finisher. As embodied herein, the finisher (not shown) may include a binding device such as a stapler or a clip fitting unit, a hole punching device, or may merely be an output tray for collecting finished copy sheets.

A fourth sheet path 70 extends from duplex tray 64 to inlet nip 33, and a fifth sheet path 72 connects copy sheet source 74, such as a sheet feeder, to fourth sheet path 70. An image transfer station 78 of a photoreceptor belt circuit 76 is positioned adjacent fourth sheet path 70. Thus, when a sheet from copy sheet source 74 passes transfer station 78, an image developed by photoreceptor circuit 76 is transferred to the copy sheet.

If the copy to be made is a single pass copy such as a single sided, single color copy, gate 80 disposed downstream of fuser rollers 82 directs the copy sheet directly to a finisher. Otherwise, for multiple pass copies, double-sided copies and inverted copies, gate 80 directs the copy sheet into inlet nip 33 of inverter/gating station 10.

For double-sided copying, a controller (not shown) directs a copy sheet out of inverter/gating station 10 through exit nip 35. The copy sheet then proceeds to duplex tray 64 and back to transfer station 78 where a developed image is printed on the opposite side of the copy sheet at transfer station 78.

For multiple pass copies such as color copies, a copy sheet exits inverter/gating station 10 through bypass rollers 26 and 28. After the sheet leaves duplex tray 64, it returns to transfer station 78 where a second image may be superimposed over the first image.

If it is desirable to invert copy sheets prior to outputting them to the finisher, such copy sheets can be directed into inverter/gating station 10 through inlet nip 33 and directed out of inverter/gating station 10 through exit nip 31.

Figure 7:
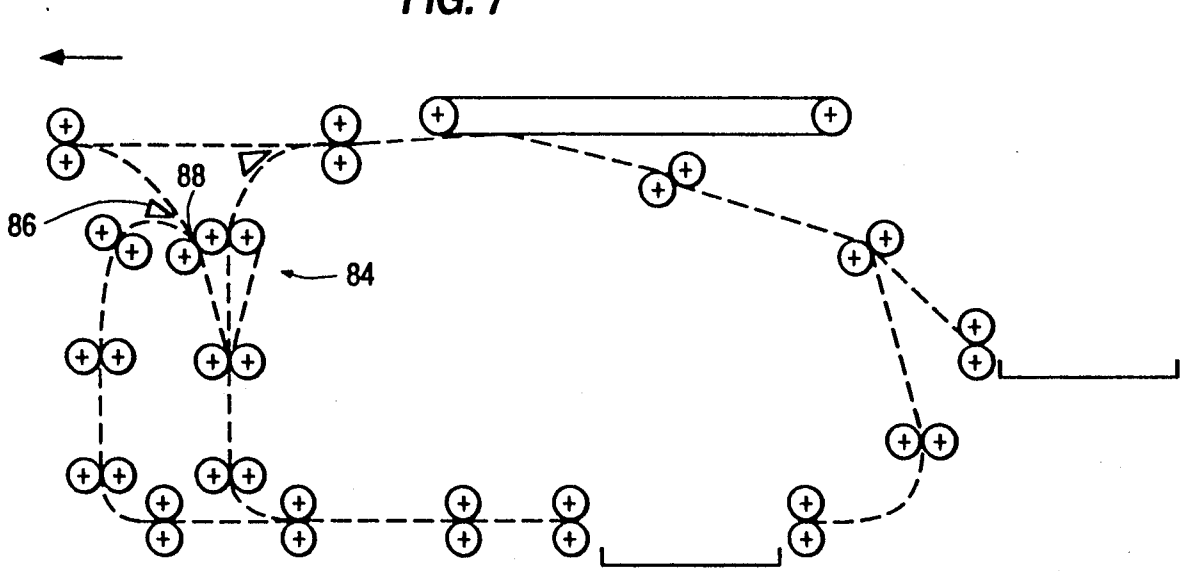
FIG. 7 is a schematic diagram depicting copy machine architecture employing a tri-roller inverter/gating station in accordance with the present invention.
Figure 8:
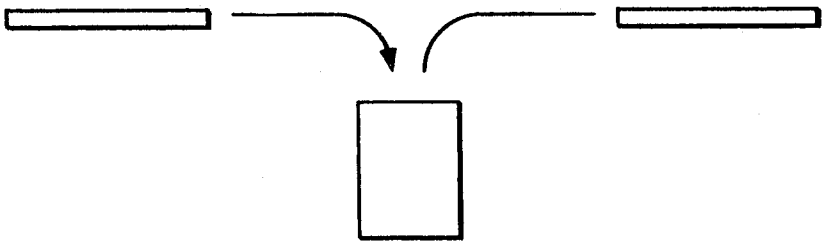
FIG. 8 PRIOR ART
FIG. 8 is a schematic diagram generally depicting the function of sheet inverters.

As shown in FIG. 7, a tri-roller inverter 84 may be employed along with an additional gate 86 to accomplish a function similar to the function achieved by the copier disclosed in FIG. 6. According to the embodiment shown in FIG. 7, gate 86 selectively directs copy sheets exiting through exit nip 88 to either the duplex tray or the finisher.

Figure 5:
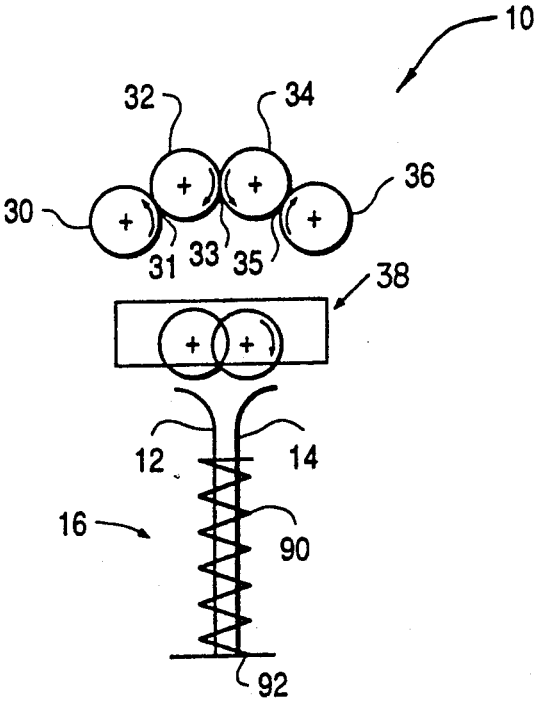
FIG. 5 is a schematic diagram depicting a bidirectional inverter without a sheet bypass, in accordance with the present invention.

The various direction change mechanisms shown in FIGS. 2–4 may be employed in a copy machine without the use of bypass rollers 26 and 28, as shown in FIG. 5. According to this alternative embodiment, spring backstop 90 may be disposed about baffles 12 and 14 of sheet pocket 16. When a sheet enters sheet pocket 16, spring backstop 90 absorbs the energy of the incoming sheet, supplies back energy to the outgoing sheet, and accommodates appropriate sheet length between inlet nip 33 and the rear end 92 of backstop 90 for various paper sizes.

The inversion process with the embodiment shown in FIG. 5 can be described as follows. A sheet is fed through inlet nip 33 into sheet pocket 16. As a lead edge of the sheet comes into contact with spring backstop 90, the copy sheet is decelerated to a stop, its direction is reversed, and the sheet is accelerated and directed to a desired exit nip by direction change mechanism 38.

Other embodiments of the invention will be apparent to those skilled in the art from consideration of the specification and practice of the invention disclosed herein. It is intended that the specification and examples be considered only, with the true scope and spirit of the invention being indicated by the following claims.

What is claimed is:

1. A sheet feeding apparatus, comprising:

a sheet pocket having a first end and a second end;

roller means spaced a predetermined distance from said first end and including a plurality of sheet-feeder nips, one of said nips being an inlet nip for directing a sheet into said first end of said sheet pocket, and at least one other of said nips being an exit nip for directing a sheet out of said first end of said sheet pocket;

bypass means for selectively permitting a sheet to exit said sheet pocket via said second end thereof;

a first sheet path extending from said bypass means to a duplex tray;

a second sheet path extending from an exit nip to the duplex tray;

a third sheet path extending from an exit nip to a to the inlet nip.

2. An apparatus according to claim 1, wherein said roller means includes first, second and third sheet-feeder nips, said first nip for directing a sheet into said first end of said sheet pocket, and said second and third nips each for directing a sheet in differing directions out of said first end of said sheet pocket.

3. An apparatus according to claim 2, further including means for selectively directing a sheet in said sheet pocket toward one of said second and third nips, said directing means including opposing laterally translatable guide surfaces for guiding a sheet therebetween.

4. An apparatus according to claim 3, wherein said directing means includes a pivotably translatable baffle.

5. An apparatus according to claim 3, wherein said directing means includes a movable shuttle with reversing rollers mounted thereon.

6. An apparatus according to claim 3, wherein said directing means includes pivotably translatable rollers.

7. An apparatus according to claim 1, wherein said roller means includes at least four rollers being rollingly engaged with each other.

8. An apparatus according to claim 1, wherein said roller means includes four rollers engaged to provide one inlet nip and two exit nips.

9. An apparatus according to claim 1, wherein said roller means includes three rollers engaged to provide one inlet nip and one exit nip.

10. An apparatus according to claim 1, wherein an image transfer station is disposed along the fourth sheet path.

11. An apparatus according to claim 1, further including a fifth sheet path connecting a sheet source with said fourth sheet path.

12. A sheet feeding apparatus, comprising:

a sheet pocket having a first end and a second end;

roller means spaced a predetermined distance from said first end for defining a plurality of spaced sheet-feeder nips, said roller means including at least four contiguous counter rotatable rollers to define at least three of said nips, a central one of said three nips being an inlet nip for directing a sheet into said first end of said sheet pocket, and at least the other two of said three nips being exit nips for directing a sheet out of said first end of said sheet pocket; and a directional change mechanism disposed between said roller means and said sheet pocket for directing a sheet exiting said sheet pocket to a selected exit nip, said directional change mechanism including a pair of reversing rollers for defining a reversing nip, and means for translating the reversing rollers to direct a sheet from said reversing nip to a selected one of said two exit nips.

13. An apparatus according to claim 12, wherein said reversing rollers are mounted on a laterally movable shuttle.

14. An apparatus according to claim 12, wherein said reversing rollers are pivotably translatable about said reversing nip.

15. An apparatus according to claim 12, further including a spring backstop means for decelerating a sheet entering said sheet pocket through said inlet nip and for accelerating a sheet in said sheet pocket toward a desired exit nip.

* * * * *